United States Patent [19]

Scott

[11] 4,418,116

[45] Nov. 29, 1983

[54] COPOLYESTER BINDER FILAMENTS AND FIBERS

[75] Inventor: Paul T. Scott, Kinston, N.C.

[73] Assignee: E. I. Du Pont de Nemours & Co., Wilmington, Del.

[21] Appl. No.: 317,874

[22] Filed: Nov. 3, 1981

[51] Int. Cl.[3] ..... D02G 3/04; D02G 3/34; D04H 1/04; D04H 3/14

[52] U.S. Cl. ..... 428/288; 428/198; 428/296; 428/360; 428/362; 428/369; 428/395; 428/401

[58] Field of Search ..... 428/288, 296, 360, 362, 428/369, 395, 401, 198

[56] References Cited

U.S. PATENT DOCUMENTS 3,554,976 1/1971 Hull .
3,989,788 11/1976 Estes et al. .
4,025,592 5/1977 Bosley et al. .
4,068,036 1/1978 Stanistreet .
4,129,675 12/1978 Scott .
4,328,278 5/1982 Sublett ..... 428/287

FOREIGN PATENT DOCUMENTS 1601586 11/1981 United Kingdom .

OTHER PUBLICATIONS

*Progress Colloid and Polymer Science 62* 88–92 (1977) by W. P. Frank and H. G. Zachmann.
*Research Disclosure,* Sep. 1975, p. 14, No. 13717.
Chemical Abstracts 86:44618 (1977).
Chemical Abstracts 94:84767 (1981).
Chemical Abstracts 96:36056 (1982).

*Primary Examiner*—James C. Cannon

[57] ABSTRACT

Novel improved copolyester binder filaments and fibers consist essentially of the terephthalate of ethylene and diethylene glycols with the mol percent of the latter being in the range of 20 to 45 percent.

8 Claims, No Drawings

COPOLYESTER BINDER FILAMENTS AND FIBERS

DESCRIPTION

Technical Field

This invention relates to novel synthetic copolyester binder filaments and fibers which are useful for thermally bonding other filaments or fibers together, for example, in nonwoven continuous filament sheet or fabric-like products and in fiberfill batts.

BACKGROUND ART

For certain applications synthetic textile filaments and fibers are mixed with lower-melting synthetic binder filaments or fibers which, when properly heated, soften or melt to provide interfilament or interfiber bonding which stabilizes the fibrous structure. The use of copolyester binder fibers in fiberfill batts is described in U.S. Pat. Nos. 4,129,675 (Scott) and 4,068,036 (Stanistreet) and also in *Research Disclosure,* September 1975, Article No. 13717, page 14. The use of copolyester binder filaments for consolidating nonwoven webs and sheets is described in U.S. Pat. No. 3,989,788. These copolyester binders obtain their binder properties through replacement of some terephthalate repeating units in poly(ethylene terephthalate) with isophthalate units.

To modify poly(ethylene terephthalate) by copolymerization for use in films or fibers having a desired modified thermal response, it has commonly been considered preferable to employ a diacid comonomer rather than a glycol comonomer. Such preference is represented, for example, by the use of isophthalate copolymer units in binder filaments and fibers referenced above. This preference is also taught in U.S. Pat. No. 3,554,976 (Hull) which discloses copolymers of poly(ethylene terephthalate) with diethylene glycol (DEG) for films but it further teaches that replacement of some of the terephthalate repeating units with another diacid gives a desirable change of glass transition temperature combined with a minimal melting point depression. Inclusion of some azelate units provides more desirable properties than poly(ethylene terephthalate) modified with the diethylene glycol alone. This failure to appreciate any utility for poly(ethylene terephthalate) containing a large amount of diethylene glycol units is further substantiated in U.S. Pat. No. 4,025,592 on texturing yarns where the diethylene glycol content is limited to less than 4 mol percent to avoid undesirable effects on yarn properties.

Objects of this invention include improved copolyester binder filaments and fibers which provide effective bonding over a broad range of temperatures which range extends above and below their melting points, which are made from inexpensive readily available monomers and which can be prepared by polymerization and melt spinning using conventional apparatus designed for poly(ethylene terephthalate).

DISCLOSURE OF THE INVENTION

This invention provides a copolyester binder filament, or fiber, wherein the copolyester consists essentially of a terephthalate copolymer of ethylene and diethylene glycols where the mol percent of diethylene glycol based on the mols of terephthalate units is within the range of from 20 to 45 mol percent, and preferably from 25 to 35 mol percent. Accordingly the remaining glycol, complementally 80 to 55 mol percent, consists essentially of ethylene glycol.

This invention comprehends filaments and fibers as interchangeable terms in the general sense; but where a more specific acknowledgement of length is appropriate the term "fibers" is intended to refer to short filaments as in "staple fibers". Hereafter only one of the terms may be used.

Filaments within the foregoing range of chemical composition are found to possess a broad range of useful bonding temperatures extending above and well below the crystalline melting point. This broad range of operating temperatures provides broad utility with respect to a variety of process conditions and end use applications, as well as reduced sensitivity and criticality to the process parameters of speed, temperature, mass and pressure.

Because of the copolymer effect on the ability of polymers to crystallize, the filaments of this invention are substantially amorphous. Their degree of crystallinity is of less significance where the binder filaments are to be used at a temperature above their crystalline melting point and resulting in their melting. In applications where bonding is to be achieved at a temperature below the melting point, commonly assisted by pressure, it is preferred that the filaments be prepared under conditions which deter their crystallization, since more crystallinity tends to raise the softening or tack temperature of the filaments. For such applications, the filaments preferably should have a crystallinity of less than about 25% as determined by density and as described herein. This preferred more amorphous nature of the filaments can be preserved by avoiding exposure of the filaments to a temperature greater than about 65° C. after melt spinning and prior to being bonded. The filaments of the invention have an acceptably low rate of crystallization which permits the filaments to be crimped, handled and tack-bonded when desired, without substantially increasing their crystallinity. But a more significant increase in crystallinity can be obtained if desired.

The filaments may be used as-spun (undrawn) or in a stretched (drawn or oriented) condition. Drawing to reduce denier or for increasing orientation can be accomplished with proper precautions without substantially affecting the amorphous nature of the filaments. During stretching it is preferred that the filament temperature in the stretch zone be kept below about 55° C. After crimping they should be dried and relaxed in an oven where the temperature does not exceed 65° C. They may be spun, crimped and optionally stretched using conventional polyester staple manufacturing equipment, including for instance a stuffer box crimper.

Fibers normally will be spun, combined to form a tow, optionally stretched and crimped in tow form. The tow is cut to staple of the desired length in a conventional staple cutting operation during which, if desired, the binder fiber may be cutter-blended with conventional fiberfill or staple fibers (e.g., 5 to 35% by weight of binder), for example of poly(ethylene terephthalate).

For use with commercial polyester fiberfill of poly(ethylene terephthalate) it is most preferred that the copolyester binder fibers contain sufficient diethylene glycol to provide a melting point of less than about 190° C. This can be achieved with a diethylene glycol mol percent of at least about 29%. Binder fibers having much higher melting points require bonding temperatures sufficiently high to have a detrimental effect on product bulk. At DEG concentrations above about 45 mol percent, solvent sensitivity and hydrolitic stability are severe and the utility in textiles is limited.

In spite of the dilution of the aromatic ring content in the polymer chain brought about by replacing ethylene linkages with diethylene ether linkages, the filaments may be spun, crimped and drawn using conventional poly(ethylene terephthalate) manufacturing equipment. Likewise the polymers can be polymerized in conventional poly(ethylene terephthalate) equipment. For acceptable melt-spinning performance the polymers should have an RV of at least about 16 and preferably at least about 18 for a more sufficient melt viscosity.

Test Methods

Percent diethylene glycol in polyester fibers is determined by a gas chromatographic analysis. The diethylene glycol is displaced from the ester groups by heating with 2-aminoethanol containing benzyl alcohol as a standard. The reaction mixture is diluted with isopropyl alcohol (2-propanol) before injection into a gas chromatograph. The ratio of the areas of the DEG and benzyl alcohol peaks are translated by a slope factor into weight percent DEG. The instrument is calibrated and standards prepared and used containing known concentrations of DEG in the conventional manner for such analyses.

The density of fibers is determined using a three-foot high conventional density gradient column which contains a mixture of carbon tetrachloride and n-heptane with densities increasing linearly from 1.4250 at the bottom to 1.3000 at the top. Small samples of fiber are put into the gradient column and allowed to come to rest at a level that corresponds to its density. The density of the sample is calculated from its height in the tube that is measured with a cathotometer in relation to heights of calibrated density balls above and below the sample.

"Relative viscosity" is the ratio of the viscosity of a solution of 0.8 grams of polyester, dissolved in 10 ml. of hexafluoroisopropanol containing 80 ppm $H_2SO_4$ to the viscosity of the $H_2SO_4$-containing hexafluoroisopropanol itself, both measured at 25° C. in a capillary viscometer and expressed in the same units.

Melting points reported, unless otherwise stated, are obtained in the conventional way using a Differential Thermal Analyzer (DTA) apparatus.

The method used to determine initial softening temperatures is similar to the procedure described by Beaman and Cramer, *J. Polymer Science* 21, page 228 (1956). A flat brass block is heated electrically to raise the block temperature at a slow rate. At intervals the fibers are pressed against the block for 5 seconds with a 200 gram brass weight which has been in continuous contact with the heated block. The fiber softening temperature is taken as the temperature of the block when the fibers tend to stick to each other.

For crystallinity, density is taken as a measure of it:

100% crystalline density* = 1.455 g/cm.$^3$
Amorphous polymer density* = 1.331 g/cm.$^3$
Measured density = $1.455\ C^* + (1 - C) \times 1.331$
Percent crystallinity is expressed as a fraction of the 100% value.

*Daubeny, R. P. de, C. W. Bunn, C. J. Brown, Proceedings of the Royal Society, A 226, 531 (1954).

Equipment for measuring crystalline half-time is:

Mettler FP-5 Control Unit
Mettler FP-52 Hot Stage Furnace
Polarizing Microscope
Watson Exposure Meter (Photometer for Microscope)
Varian A-5 Strip Chart Recorder.

The Mettler FP-52 furnace is mounted on the stage of the polarizing microscope. The FP-5 control unit accurately controls the temperature of the furnace. The polarizing microscope is equipped with a light source below the objective lens and polarizer. The microscope is operated with the two polarizers crossed to normally give a dark field. The optical sensor of the Watson exposure meter is inserted in the polarizing microscope replacing the normally used objective lens. The output of the exposure meter is connected to the Varian A-5 strip chart recorder.

For the crystallization half-time measurements, the control unit is set to maintain the furnace at 150° C. For each specimen tested, a pyrex microscope slide is placed on a hot plate at a temperature approximately 40° C. above the melting temperature of the polymer. Approximately 0.2 g polymer (pellet or fiber) is placed on the slide about ¾ inch from the end of the slide. A micro cover glass is placed on the polymer and the cover glass pressed gently until the polymer forms a uniform film under the cover glass. The slide containing the polymer is then removed and immediately quenched in water to insure an amorphous sample. After drying, the slide is inserted into the hot stage furnace and the recorder started with a speed of 1 cm/min. The pen position, at the start of the recorder and at the time of the furnace recovery to 150° C., is marked. The initial base line trace indicates dark field (no light transmission). As crystallization proceeds, the crystallites rotate the plane of polarization and the resulting light transmitted is a function of the degree of crystallization. The trace on the recorder contains an "S" shaped transition from no-transmission to full-transmission. The elapsed time between the start of the recorder and the inflection point of the curve, corrected for the recovery time for the slide, is assumed to be the half crystallization time.

EXAMPLE 1

This example demonstrates the preparation and utility of preferred copolyester binder fibers of the invention containing 29 mol percent of diethylene glycol.

Using a conventional three-vessel continuous polymerization system for polyesters coupled to a spinning machine, polymer is prepared and melt spun into filaments beginning with molten dimethyl terephthalate and a mixture of ethylene glycol and diethylene glycol. The glycol mixture contains 22.6 mol percent diethylene glycol and 77.4 mol percent ethylene glycol. The ingredients along with manganese and antimony trioxide as catalysts are continuously fed to the first vessel where ester interchange is carried out. The catalyst concentrations are adjusted to provide 125–140 ppm Mn and 320–350 ppm Sb in the polymer. The mole ratio of glycol to dimethyl terephthalate is 2 to 1. To the liquid product of the ester interchange vessel is added sufficient phosphoric acid to give 50–80 ppm phosphorus in polymer and a glycol slurry of $TiO_2$ to provide 0.3 weight percent of the delusterant in the polymer. The mixture is transferred to the second vessel where the temperature is increased and the pressure is reduced as polymerization is initiated in a conventional manner. Excess glycol is removed through a vacuum system. The low molecular weight polymer is transferred to a third vessel where the temperature is raised to 285°-290° C. and the pressure is reduced to about 1 mm. mercury. The polymer so produced has a relative viscosity of 20.8±0.5 and has a diethylene glycol content of 15.1±0.5 weight percent (29 mol percent based on terephthalate units).

The polymer is passed directly to a conventional spinning machine and melt spun at a spinning block temperature of about 280° C., quenched with air and collected as filaments having a denier of 5 at a speed of 1200 ypm (1097 mpm).

These filaments are further processed to provide two binder fiberstocks of the invention: one of 5 dpf without any stretching and one of about 1.5 dpf which has been stretched to provide this lower denier. Both products are processed on a conventional polyester staple draw machine (but without any stretching for the former). Sufficient ends of the spun filaments are combined to give a crimped rope (tow) denier of about 1 million and crimped using a stuffer box crimper. The 5 dpf product has about 8 crimps per inch (3.1/cm.) and the 1.5 dpf product about 10 crimps per inch (3.9/cm.). During the processing all temperatures in the staple draw machine are kept at or below about 55° C. After crimping the products are air dried in a relaxer oven with the temperature being kept below 65° C.

Measured at an extension rate of 400%/min. single filament tensile properties are:

| dpf | Initial Modulus | Tenacity | % Elongation |
|---|---|---|---|
| 5.0 | 17 | 1.3 | 360 |
| 1.5 | 28 | 4.3 | 45 |

The fibers of both products remain quite amorphous as shown by a density of 1.3532 corresponding to a calculated crystallinity of about 18%.

The crimped 5 dpf rope of filaments is cutter blended at a 25% by weight level with a commercial 5.5 dpf, round 14.5% hollow filament cross section polyester fiberfill of two inch (5.1 cm.) cut length and the blended fibers are processed on a garnetting machine to give batts for either oven or hot roll bonding.

Useful processing temperatures for hot roll bonding of the fiberfill are 250°-350° F. (121°-177° C.) and oven bonding are 360°-385° F. (182°-196° C.).

The 5 dpf product is found useful also as a binder fiber for blending with a 15 dpf fiberfill of poly(ethylene terephthalate) for use as a stuffing material in furniture.

The stretched 1.5 dpf product is blended with a 1.5 dpf conventional staple product of poly(ethylene terephthalate) for use as a binder in the manufacture of nonwoven blended sheets such as diaper coverstock. The stretching results in a higher shrinkage tension than for the unstretched fibers, therefore the unstretched fibers are found to be preferred in uses where the shrinkage is undesirable, for example in the fiberfill batts where shrinkage reduces bulk.

EXAMPLE 2

This example compares copolyester binder fibers of the invention with ones (not of the invention) containing 17 mol percent of diethylene glycol.

Polymer is prepared substantially as in Example 1 except the glycol mixture contains 15.5 mol percent diethylene glycol and 84.3 mol percent ethylene glycol. The polymer has a relative viscosity of 20.8±0.5 and a diethylene glycol content of 9.0±0.5 weight percent (17 mol percent based on dimethyl terephthalate).

Filaments are spun from the polymer and processed substantially as in Example 1 into about 5 dpf (unstretched) fibers. Temperatures in the staple draw machine and relaxing oven are maintained as before to avoid substantial crystallization of the fibers during processing.

The bonding effectiveness of these 17 mol percent DEG fibers is compared to that of 29 mol percent DEG fibers like those of Example 1 in nonwoven fabrics. The binder fibers are blended with commercial polyester 5.5 dpf fiberfill (Du Pont Type 808) in a ratio of 25% binder fiber and 75% fiberfill. The blends are processed on a garnetting machine into nonwoven batts which are converted into bonded nonwovens using light pressure with a heated roll and a contact time of 8 seconds. Samples of the sheets bonded at different temperatures are tested for grab tear strength using samples 2.54 cm by 15.24 cm with the following results:

| | | Grab Tear Strength | | | | |
|---|---|---|---|---|---|---|
| Binder Mol % DEG | Hot Roll, °C. | Fabric oz/yd$^2$ | Weight (g/m$^2$) | Elong. % | Brk. lbs. | St. (kg) |
| 17 | 177 | 3.39 | (115) | 32 | 1.1 | (0.5) |
| 17 | 196 | 3.78 | (128) | 37 | 4.4 | (2.0) |
| 29 | 126 | 2.79 | (95) | 30 | 0.17 | (0.1) |
| 29 | 155 | 2.89 | (98) | 38 | 4.5. | (2.0) |
| 29 | 177 | 3.30 | (112) | 49 | 5.9 | (2.7) |

A comparison of the second and fourth items shows that about a 40° C. higher temperature is required with the 17% DEG item to provide fabric strength equal to that of the 29 mol percent item.

Oven bonding using the 17 mol percent DEG fiber requires unduly high temperatures of greater than about 435° F. (225° C.).

EXAMPLE 3

This example demonstrates crystalline properties and the temperature range between softening temperature and the melting point of fibers containing different amounts of diethylene glycol.

Copolymers are conventionally prepared from diethylene glycol, ethylene glycol and dimethyl terephthalate. They are melt spun and made into fibers. The diethylene glycol content of the polymers and corresponding fiber properties are shown in Table 1.

TABLE 1

| Mol % DEG | g/mL Density | Cryst. % | T ½ (Min.) | MP °C. | Softening Point °C. |
|---|---|---|---|---|---|
| 29 | 1.3532 | 18 | — | 193 | 105 |
| 29 | 1.3532 | 18 | — | 190 | 105 |
| 16.9 | 1.3435 | 10 | — | 218 | — |
| 27.1 | 1.3549 | 19 | 4.8 | 189 | — |
| 26.9 | 1.3517 | 17 | 5.7 | 192 | — |
| 27.5 | 1.3527 | 18 | 4.0 | 194 | — |
| 23.1 | 1.3501 | 15 | 4.2 | 197 | — |
| 18.1 | 1.3433 | 10 | 1.6 | 216 | 135 |
| 11.3 | 1.3414 | 8 | 1.5 | 231 | 135 |
| 29* | 1.3637 | 28 | — | 193 | 160 |
| 43 | 1.3310 | 0 | — | 175 | 85 |
| 22.9 | — | — | — | — | 115 |

*Sample crystallized in boiling water and dried in oven at 135° C. for one hour.

From Table 1, it is seen that fibers of polymers containing more than 20% diethylene glycol have a half-life of time for crystallization at 150° C. which is significantly greater than for fibers containing less than 20% diethylene glycol. A slower rate of crystallization is particularly beneficial for bonding applications at temperatures below the crystalline melting point of the binder fiber. It is also seen that the less than 20% DEG fibers have a melting point significantly above 200° C. which is generally undesirable for use with present conventional synthetic fibers.

When the 29% fiber is made more crystalline by heating, it is seen that its softening temperature is increased considerably, making it less desirable as a binder fiber than the more amorphous fibers.

EXAMPLE 4

This example demonstrates the greater effectiveness of a binder fiber of this invention over a range of bonding temperatures compared to a commercial copolyester binder fiber.

Filaments are melt spun and stretched to provide a denier per filament of 1.8 in a manner substantially as described in Example 1 except that the mol percent of diethylene glycol in the copolyester is 26 mol percent. The filaments are crimped and cut to 1½ inch (3.8 cm.) staple fibers. The filaments have a melting point of 186° C.

These copolyester fibers are blended with conventional 1.5 dpf, 1½ in. (3.8 cm.) staple fibers of poly(ethylene terephthalate) in a 25/75 ratio by weight respectively and garnetted into a batt suitable for feeding a carding machine. The fibers are carded to give webs weighing about 0.50 oz./yd.$^2$ (17.0 g/m$^2$). Samples of the web are then pressed using a Reliant model platen press at various temperatures using a 10 second exposure and 1.5 lbs./in.$^2$ (106 g/cm$^2$) pressure. The thermally bonded samples are then tested for strength using 1 inch×7 inch (2.5 cm.×17.8 cm) strips in an Instron® tensile testing machine. Comparable samples are prepared and tested using a commercial copolyester binder fiber of a polymer made from ethylene glycol and a 30/70 mol ratio of dimethyl isophthalate and dimethyl terephthalate. The data are shown in Table 2.

TABLE 2

| | DEG/2G-T* | | 2G-I/T** | |
|---|---|---|---|---|
| Temp. °C. | Basis Wt., oz./yd$^2$ (g/m$^2$) | Brk. Str. lb./in. (g/cm) | Basis Wt., oz./yd$^2$ (g/m$^2$) | Brk. Str. lb./in. (g/cm) |
| 140 | 0.46 (16) | 0.02 (3.6) | 0.50 (17) | 0.03 (5.4) |
| 155 | 0.48 (16) | 0.03 (5.4) | 0.54 (18) | 0.08 (14) |
| 170 | 0.48 (16) | 0.05 (8.9) | 0.48 (16) | 0.16 (29) |
| 185 | 0.50 (17) | 0.16 (29) | 0.50 (17) | 0.21 (38) |
| 200 | 0.48 (16) | 0.28 (50) | 0.48 (16) | 0.19 (34) |
| 215 | 0.50 (17) | 0.36 (64) | 0.50 (17) | 0.32 (57) |

*M.P. 186° C.
**M.P. 117° C.

The basis weight and breaking strength values of Table 2 are average values. The variability among samples of the breaking strength values at a given temperature is significantly less overall for the DEG fiber compared to the control fiber in spite of the higher M.P. for the former. For the entire temperature range tested, the average variability in breaking strength for the DEG fibers is ±16% as compared to ±24% for the control fibers.

EXAMPLE 5

This example compares the range of temperatures separating the initial softening temperature and the melting point for a copolyester fiber of this invention with those of some known commercial binder fibers of other synthetic polymers.

The polymers tested are: the copolyester of Example 4 containing 26/74 mol percent of diethylene glycol and ethylene glycol (DEG-2G-T) respectively; the control of copolyester of Example 4 of ethylene glycol with dimethyl isophthalate and dimethyl terephthalate in a mol ratio of 30/70% (I/T) respectively; polypropylene; a terephthalate copolymer of ethylene glycol and 1,4-bis-hydroxymethyl cyclohexane (2G/HPXG-T); and a copolymer of vinyl chloride and vinyl acetate. The results are shown in Table 3.

TABLE 3

| | Temperature (°C.) | |
|---|---|---|
| | Initial Softening | Final Melting |
| DEG/2G-T Copolymer | 69 | 186 |
| 2G-DMI/DMT Copolymer | 75 | 117 |
| Polypropylene | 156 | 166 |
| 2G/HPXG-T Copolymer | 82 | 110 |
| Vinyl Chloride/Vinyl Acetate Copolymer | 69 | 135 |

These data were obtained using a Fisher Digital Melting Point Analyzer (Model 355). The fiber sample was covered with a 23/32 in. (18 mm) diameter cover glass weighing 0.13 g. The temperature is raised at 25° C. per minute. The softening point is identified as that temperature at which the sample begins to show indication of flow, that is, change of contact area with the cover plate. The melting point is identified as the temperature at which the sample becomes completely liquified.

From Table 3 it is seen that the difference in the softening temperature and melting temperature for the fiber of the invention (117° C.) is considerably greater than for any of the other items. Yet the fiber of the invention has a softening temperature as low as any of the other items.

EXAMPLE 6

This example demonstrates the use of continuous binder filaments of the invention in the preparation of a spunbonded polyester nonwoven sheet product of the type described in U.S. Pat. No. 3,338,992 (Kinney).

A copolyester of the invention of ethylene and diethylene glycols with dimethyl terephthalate is prepared containing 23.9 mol percent DEG and a relative viscosity of about 20.3. This polymer is used to co-spin binder filaments for a spun bonded sheet of poly(ethylene terephthalate) continuous filaments in a manner substantially as described in Example 19 of U.S. Pat. No. 3,338,992. The poly(ethylene terephthalate) has a relative viscosity of about 24.

Identical machine settings are then used to produce a control sheet product in which the cospun copolyester binder filaments are of a commercially used copolymer of poly(ethylene terephthalate)/poly(ethylene isophthalate) in an 83/17 mol ratio having a relative viscosity of about 22.

Sheet products are produced (from both items) having a basis weight of 0.5 oz./yd.$^2$ (17 g/m$^2$). The sheets are prepared using a commercial jet/diffuser combination (substantially as described in U.S. Pat. No. 3,766,606) with a steam consolidator and air restraint bonder (essentially as described in U.S. Pat. No. 3,989,788).

The poly(ethylene terephthalate) filaments are spun through spinneret holes 0.009 in. in diameter and 0.012 in. long (0.23 mm. by 0.30 mm.) at a polymer throughput of 0.636 g/min/hole. The binder filaments are spun through a spinneret having holes for producing symmetrical trilobal filaments which holes are comprised of three radially intersecting slots 0.005 in. wide and 0.015 in. long (0.13 mm by 0.38 mm). The capillary length is 0.007 in. (0.18 mm). The copolyester is spun at a rate of 0.75 g/min/hole. For the bonding, the air restraint bonder air temperature is 233° C. Comparative physical properties of the two products are tabulated in Table 4.

TABLE 4

| Property* | DEG Binder | Commercial Control |
|---|---|---|
| Tensile Strength, lb./in. (g/cm) | 3.15 (563) | 2.88 (515) |
| Break Elongation, % | 46 | 40 |
| Initial Modulus, psi (g/m$^2$) | 18.9 (5.54) | 19.7 (5.77) |
| Grab Tensile Strength, lb. (kg) | 9.8 (4.5) | 9.1 (4.1) |
| Tongue Tear, lb. (kg) | 1.8 (0.82) | 1.6 (0.73) |
| Trapezoidal Tear, lb. (kg) | 6.8 (3.1) | 5.9 (2.7) |
| Bonding Length, cm | 3.7 | 3.7 |
| Dry Heat Shrinkage 170° C., % | 0.3 | 0.3 |

*All values are averages of machine and cross-machine direction values.

I claim:

1. A copolyester binder filament wherein the copolyester consists essentially of a terephthalate of ethylene and diethylene glycols and the mol percent of diethylene glycol based on the mols of terephthalate is within the range of 25 to 35%, with the binder filaments having a crystallinity based on fiber density of less than 25%, and the copolyester having a crystalline half-time at 150° C. of greater than 2 minutes.

2. A filament of claim 1 having a denier within the range of from about 1 to 20.

3. A filament of claim 1 which is a crimped fiber having an extended length within the range of 2.5 to 12 cm.

4. A filament of claim 1 having a crystalline melting point of less than 200° C.

5. A filament of claim 1 wherein the copolyester consists of the terephthalate of ethylene and diethylene glycols.

6. A blend of filaments suitable for making a heat-bonded filament structure consisting essentially of filaments of poly(ethylene terephthalate) and from 5 to 35% by weight of binder filaments of a copolyester which consists essentially of a terephthalate of ethylene and diethylene glycols in which copolyester the mol percent of diethylene glycol based on mols of terephthalate is within the range of 25 to 35%, with the binder filaments having a crystallinity based on fiber density of less than 25%, and the copolyester having a crystalline half-time at 150° C. of greater than two minutes.

7. A filament blend of claim 6 in the form of a fiberfill batt.

8. A filament blend of claim 6 in the form of a nonwoven sheet.

* * * * *